United States Patent [19]

Smith

[11] 4,204,883

[45] May 27, 1980

[54] TARNISH RESISTANT COPPER ALLOY

[75] Inventor: Richard D. Smith, Acton, Mass.

[73] Assignee: Kennecott Copper Corporation, New York, N.Y.

[21] Appl. No.: 938,714

[22] Filed: Aug. 30, 1978

Related U.S. Application Data

[60] Division of Ser. No. 769,723, Feb. 17, 1977, Pat. No. 4,113,475, which is a continuation-in-part of Ser. No. 675,604, Apr. 9, 1976, abandoned.

[51] Int. Cl.[2] ..... C22C 9/01; C22F 1/08

[52] U.S. Cl. ..... 148/2; 148/11.5 C

[58] Field of Search ..... 75/153, 159, 162; 148/2, 32, 32.5, 11.5 C, 12.7 C

[56] References Cited

U.S. PATENT DOCUMENTS

| | | | |
|---|---|---|---|
| 1,496,269 | 6/1924 | Iytaka | 75/162 |
| 3,297,497 | 1/1967 | Eichelman, Jr. et al. | 148/12.7 C |
| 4,113,475 | 9/1978 | Smith | 75/159 |

FOREIGN PATENT DOCUMENTS

| | | | |
|---|---|---|---|
| 324358 | 1/1935 | Italy | 75/159 |
| 441064 | 10/1948 | Italy | 75/162 |

OTHER PUBLICATIONS

The Journal of the Institute of Metals, 1937, vol. LXI, pp. 83–102.

The Journal of the Institute of Metals, 1939, vol. LXV, pp. 217–223.

*Primary Examiner*—L. Dewayne Rutledge
*Assistant Examiner*—Peter K. Skiff
*Attorney, Agent, or Firm*—John L. Sniado; Anthony M. Lorusso

[57] ABSTRACT

A copper base alloy of superior tarnish resistance consisting essentially of 7.0 to 8.5% aluminum by weight and 1.5 to 2.5% nickel by weight with the balance (89–91.5 wt %) being essentially copper.

The process by which the alloy is prepared is controlled so that the alloy is primarily single phased, i.e., a face centered cubic alpha phase solid solution containing a fine dispersion of nickel aluminide compound (NiAl) and less than 2 volume percent of the brittle intermetallic phases known as beta and gamma. By composition control and by producing an essentially single phase microstructure, the alloys of the invention are capable of forming a stable oxide film having high tarnish resistance.

The alloy, upon prolonged exposure indoors to ambient air and frequent handling, develops a very thin, tight, uniform oxide film which, although visible, is still attractive and does not mask the basic warm tone of the base metal. This film, when intact, serves to protect the underlying metal from further oxidation, and when damaged, is self-healing and reestablishes itself to provide a uniform protective and decorative film.

9 Claims, 6 Drawing Figures

405 AS/CAST 250X

404 AS/CAST 250X

404 ANN. 250X 404 700°C 300X

TARNISH RESISTANT COPPER ALLOY

CROSS REFERENCE TO RELATED APPLICATIONS

This is a division of application Ser. No. 769,723, filed Feb. 17, 1977 now U.S. Pat. No. 4,113,475, which is a continuation-in-part of copending patent application Ser. No. 675,604 entitled TARNISH RESISTANT COPPER ALLOY, filed on Apr. 9, 1976, now abandoned the teachings of which are incorporated herein by reference.

BACKGROUND OF THE INVENTION

Copper base alloys upon prolonged exposure to air at room temperature develop non-uniform and unattractive oxide films commonly referred to as tarnish. To prevent such tarnishing, a variety of clear coatings have been developed that are either very costly or are subject to damage in use and resultant local tarnishing and corrosion under the coating. Thus, while the majority of copper base alloys possess the required formability for fashioning into useful articles, their lack of tarnish resistance limits their use in areas where these articles are also intended to serve a decorative function.

The search for a copper base alloy having a stainless property, that is, one which does not require a protective coating, has been active for many years. Indeed, the International Copper Research Association (INCRA) has developed an alloy of reasonable tarnish resistance that is known as INCRA C-57. This alloy consists of copper with 5 percent by weight tin and 7 percent by weight aluminum. However, this alloy is difficult to fabricate using conventional brass mill techniques. More specifically, this alloy does not hot roll very well and its cold rollability is also quite limited. In addition, the formability of the finished alloy is relatively low, severely limiting the application and utility of the alloy in the manufacture of formed articles. Thus, in order to gain the benefits of tarnish resistance in a copper base alloy, one has had a resort to compositions which possess inherently limited workability and formability. Primarily, for this reason such alloys have not gained widespread commercial acceptance.

SUMMARY OF THE PRESENT INVENTION

The alloy of the present invention offers the ability to be fabricated into a variety of useful articles which can be used indoors without any protective coating in the same manner that stainless steel is used. This unique ability provides the designer the option of selecting the warm color of a copper alloy with the additional advantage of not having to utilize a protective coating to maintain this appearance.

The alloy of the present invention is a copper based alloy that includes 7.0–8.5 weight percent aluminum, 1.5–2.5 weight percent nickel with the balance (89–91.5 wt %) consisting essentially of copper. In addition to having the foregoing composition, alloys of the present invention must be capable of spontaneously forming a thin nearly transparent film at ambient temperature which has an electrical polarization resistance of at least 95 kilohms when measured in a neutral salt solution under applied DC potential. This high film resistance is achieved by processing the alloy under conditions which result in a structure consisting of a matrix of copper-aluminum-nickel solid solution, uniform in composition and containing a very fine dispersion of NiAl intermetallic compound.

The alloy of this invention is suitable for indoor exposure and has been found to have excellent strength and formability characteristics in addition to a high order of stain resistance. Upon outdoor exposure the alloy of this invention exhibits a high order of corrosion resistance but does lose its lustre in time and turns into a uniform dull bronze color.

Accordingly, an object of the invention is to produce a copper base alloy which is resistant to oxidation and corrosion at ambient temperatures.

A further object of the present invention is to provide a copper base alloy which will assume a uniform color that is both aesthetically desirable and reasonably permanent.

A further object of the present invention is to provide a copper base alloy which will maintain an aesthetically attractive surface appearance without the need for protective coatings.

A further object of the present invention is to provide a tarnish resistant copper base alloy that assumes aesthetically pleasant tones and which offers an ability to be readily fabricated into a variety of useful articles.

A further object of the present invention is to provide a copper base alloy of high strength while at the same time providing good formability.

DESCRIPTION OF THE PREFERRED EMBODIMENTS

At the outset the alloy of the present invention is described in both its broadest overall aspects and its preferred embodiment with a more detailed description following.

Figure 1:
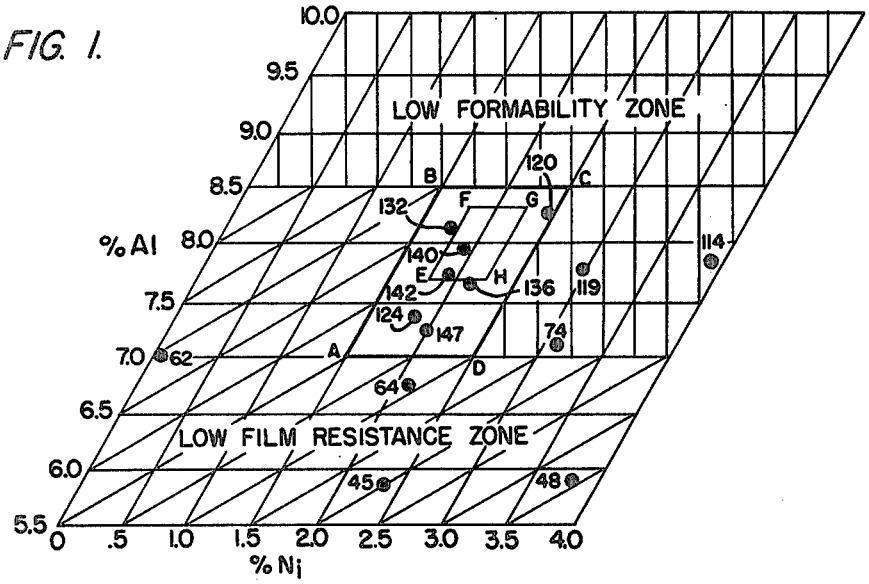
FIG. 1 is a plot of a portion of the copper-aluminum nickel ternary phase diagram showing the region encompassed by the alloy of this invention as well as showing a low formability zone and a low film resistance zone in which alloys outside of the range encompassed by this invention will lie. The numerical values for the points shown on the phase diagram indicate the film resistance in kilohms.

As is shown by the areas within parallelograms ABCD and EFGH of FIG. 1, the alloy consists of three components: copper, aluminum and nickel, with aluminum being present in the range of 7.0–8.5 weight percent and preferably 7.7–8.3 weight percent; nickel being present in the range of 1.5–2.5 weight percent and preferably 1.8–2.2 weight percent; with the balance being comprised essentially of copper. The alloys of the present invention may include, in addition to the foregoing materials, conventional impurities typically found in commercial copper base alloys. These common impurities may include: lead, tin, phosphorus, iron, manganese, zinc, and silicon in an amount up to a collective total of 0.5 wt %.

As is shown in FIG. 1, the ranges of aluminum, nickel and copper set forth above have been found to be critical for the following reasons. Aluminum contents below 7.0 percent result in lower tarnish resistance with behavior not significantly better than existing aluminum bronzes such as CA 61400. Aluminum contents above 8.5 percent result in a drastic reduction of formability and ductility of the alloy through the appearance of the brittle, complex-structure, intermetallic phases known as beta and gamma. Likewise, nickel contents below 1.5 percent result in reduced tarnish resistance and lower strength of the alloy, while nickel contents above 2.5 percent produce excessive amounts of nickel-aluminum intermetallic compounds which not only reduces formability but also through combination with a portion of the aluminum removes Al from solid solution and reduces tarnish resistance. Certain properties of alloys having compositions outside of the claimed range are also shown in FIG. 1. Within the foregoing broad ranges of constituents (as is shown by parallelogram ABCD), the desirable qualities of tarnish resistance, formability, and strength are further optimized by controlling the aluminum content to within the preferred range of 7.7–8.3 weight percent and the nickel content within the preferred range of 1.8–2.2 weight percent as is shown by parallelogram EFGH. In addition to having constituents within the foregoing ranges depicted by parallelogram ABCD, the alloy must be capable of forming a stable oxide film having a film resistance of at least 95 kilohms. Such high film resistances are achievable on the alloys of this invention when they are processed according to procedures which follow. These procedures result in the formation of a microstructure that can be characterized as an alpha phase alloy matrix containing small amounts of finely dispersed NiAl compound. The elimination of beta and gamma phases from the alloy, in part, results in the high tarnish resistance of the alloy of the invention. No evidence exists in the literature or prior art that both composition control and structure control were required to produce highest tarnish resistance in fabricable copper-aluminum-nickel alloys.

As is stated above, one unique characteristic of the alloy of the invention is due to the formation of a reaction product film of high electronic and ionic resistance. To achieve maximum resistance, it is critical that the right proportions of metal ions be present in the film. Too much or too little of any individual metal ion in the film results in lower film resistance and, hence, higher rates of oxidation. In order to provide for this critical control of the proportions of the metal ions in the film, it is important to closely control both the structure and composition of the underlying metal alloy whose atoms are incorporated into this protective oxide film.

By using an electro-chemical technique known as linear polarization, the electrical resistance of the protective oxide film can be measured. The subject alloy was found to attain very high film resistance along with fabricability only over the range of compositions claimed herein. Film resistance was determined by controlled exposure of the subject alloy to an accelerated corrosion environment and subsequent linear polarization measurements. Alloys lower in aluminum and/or nickel than the range claimed herein produce lower film resistance and thus are not significantly better than existing commercial aluminum bronzes. Alloys higher in aluminum and/or nickel have deleterious amounts of unwanted phases such as the brittle $\gamma$ and $\beta$. These undesirable phases, when present in significant amounts, drastically reduce both fabricability and formability. Thus, it is also critical that the alloys be clear of $\beta$ and $\gamma$ phases. The achievement of a high tarnish resistant alloy is thus accomplished by both composition control and structure control through proper processing conditions.

The invention is further illustrated by the following examples. At this point, it should be noted that the invention is not intended to be limited to the procedures set forth in the examples which follow, but rather these examples are provided in order to teach one skilled in the art how to practice the invention and thus, are not intended to limit the invention in any way.

EXAMPLE I

TARNISH RESISTANCE

Figure 3:
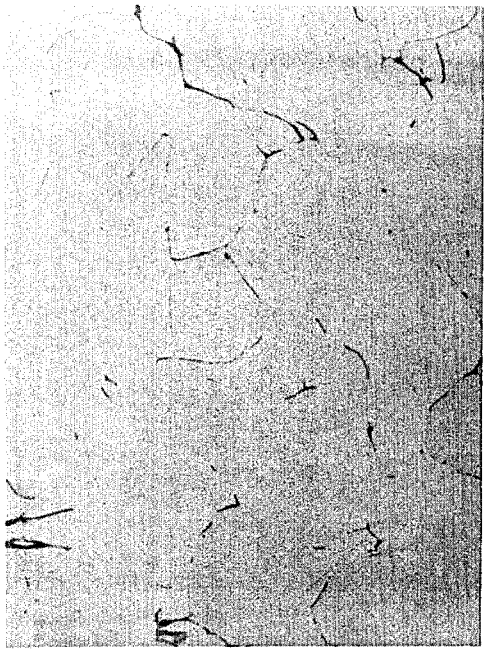
FIG. 3 is a photolithograph of the microstructures of alloy C of Table I, as cast.
Figure 4:
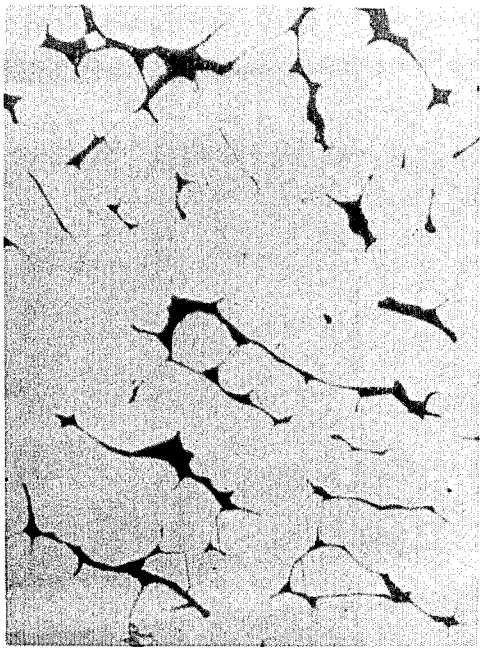
FIG. 4 is a photolithograph of the microstructures of alloy B of Table I, as cast.
Figure 5:
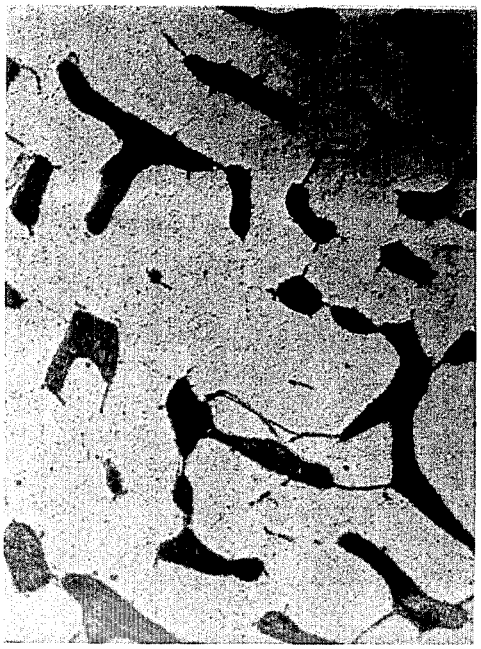
FIG. 5 is a photolithograph of the microstructures of alloy B of Table I, heat treated; and, FIG. 6 is a photolithograph of the microstructures of alloy B of Table I, hot rolled, cold rolled and annealed.
Figure 6:
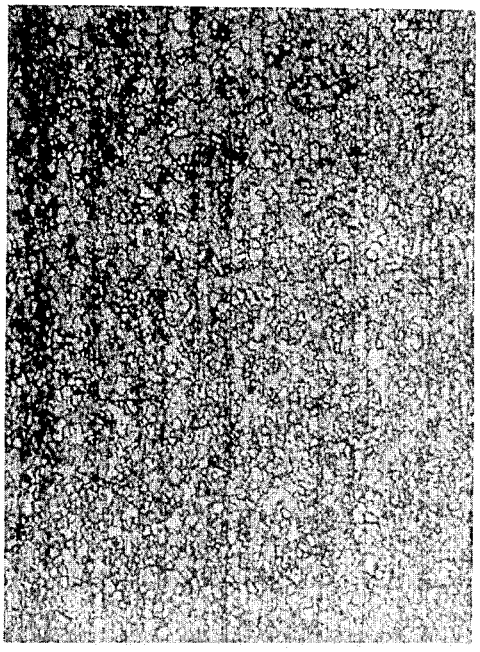

Alloys of the compositions shown in Table I were prepared by melting together the constituent metals under a charcoal cover in a clay-graphite crucible. After thorough mixing, the heats were cast into steel molds. The resulting structure varied from essentially single phase as shown in FIG. 3 for alloy C as-cast to a two-phase alpha plus 10% beta structure shown in FIG. 4 for alloy B as-cast. Due to relatively rapid cooling during casting with resultant segregation of the constituents, non-equilibrium structures are common in the as-cast condition with phases being present that are not expected from the equilibrium diagrams as well as the occurrence of local variations in composition from point to point in the alloy known as coring. These effects are sufficient to reduce the film resistance significantly below the values attainable when the metal is homogenous with respect to distribution of the alloy constituents. Also, coarse grain boundary precipitates of NiAl compound may cause a low film resistance. This is illustrated by the data in Table I for the heat treated condition of alloy B where generally lower film resistance is found for structures having coarse precipitates as shown in FIG. 5 (heat treated condition—heat B). If the NiAl compound is finely dispersed throughout the structure as is achieved in alloy B and processing of this invention as shown in Table I for the HR+CR+Ann condition of alloy B and by FIG. 6 (hot rolled, cold rolled, and annealed—heat B), then tarnish resistance and mechanical properties are enhanced. The film resistance data in Table I supports the previous statements.

TABLE I

| Alloy | Composition | Film Resistance As-Cast | Film Resistance AC + Heat Treated* | (Kilohms) HR + (CR + Ann)[3] |
|---|---|---|---|---|
| A | 7.98% Al, 2.09% Ni, Cu bal. | 57 | 93 | 105 |
| B(404) | 8.28% Al, 2.46% Ni, Cu bal. | 57 (Fig. 4) | 66 (Fig. 5) | 100 (Fig. 6) |
| C(405) | 7.68% Al, 1.91% Ni, Cu bal. | 91 (FIG. 3) | 64 | 114 |

TABLE I-continued

| Alloy | Composition | Film Resistance As-Cast | AC + Heat Treated* | (Kilohms) HR + (CR + Ann)[3] |
|---|---|---|---|---|
| D(404) | 7.67% Al, 2.39% Ni, Cu bal. | 62 | 85 | 117 |

*As-cast material homogenized at 900° C. for one hr., water quenched, then annealed 11 days at 525° C.
**As-cast material hot rolled at 900° C. to 600° C. air cooled, cold rolled 50%, annealed 1 hr. at 700° C., cold roll and anneal cycle repeated twice more It should be noted that even if the alloy contains the correct constituents in the specifed ranges, the objects of the invention will not be achieved unless the alloy is free of $\gamma$ and $\beta$ and has the bulk of the aluminum in solid solution with any excess Al and Ni in the form of a finely divided NiAl dispersion throughout the solid solution matrix.

An alloy composition range of 7.7–8.3% aluminum, 1.8–2.2% nickel with the balance copper appears to be optimum, although high tarnish resistances are noted throughout the entire broad range of 7.0–8.5% aluminum, 1.5–2.5% nickel, balance essentially copper when the alloy is processed in accordance with this invention. The alloy is of significantly improved tarnish resistance and can be utilized indoors without protective coatings. Oxidation is very slow but the alloy will eventually mellow to an attractive uniform film rather than the non-uniform and unattractive tarnish film which forms on most currently available copper base alloys. The excellent behavior of the alloy is not affected by normally encountered levels of common impurities such as iron, zinc, manganese, tin, lead, silicon or phosphorus. The alloy can be produced with reasonable ease using conventional brass mill equipment. Formability of the finished sheet and strip is sufficient to satisfy the vast majority of users.

Exploration of the Cu corner of the Cu-Al-Ni system included alloys of from 6 to 10% Al and 1 to 7% Ni. The best of these alloys, considering both film resistance and fabricability/formability behavior, were those in the preferred 7.7–8.3% Al and 1.8–2.2% Ni range. Alloys of this composition hot roll and cold roll very well, have good formability in drawing, stretching and bending modes and form an excellent high resistance film upon exposure.

EXAMPLE II

TARNISH RESISTANCE

Alloys having the composition listed in Table II were prepared from electrolytic-tough-pitch copper, nickel pellets and aluminum pellets. Preparation followed the ensuing sequence: Rods of copper were melted under a charcoal cover and heated to approximately 2100° F; a portion or all of the desired aluminum content was added to the melt and stirred at the same temperature, nickel in the form of nickel pellets or a 50—50 copper-nickel master alloy was added next and the melt held at a temperature of 2000°–2300° F. until complete solution occurred. Any remaining aluminum was next added and stirred in. The melt was stabilized at a temperature of about 2100° F. and cast into a steel mold and allowed to solidify.

The resulting ingots were reheated to 1500° F. to 1650° F. and hot rolled to at least 75% reduction in thickness, finishing at about 1000° F. The material was then cold rolled from about 0.250" to 0.120", annealed at about 1300° F. for 45 minutes, cold rolled to 0.060", annealed at about 1300° F. for 45 minutes, and cold rolled to 0.030". Tensile properties were evaluated in the 50% cold rolled condition and also in the annealed condition where temperatures of 525° F. and 1250° F. were used. Samples of the various alloys were abraded with silicon carbide abrasive, then exposed to an accelerated atmospheric corrosion test comprising alternate wet/dry cycles with a weak sodium bisulfite solution especially formulated to produce oxide films of the same nature as those found on copper alloys after several years of outdoor exposure in an urban industrial environment.

The relative ohmic resistances of the oxide film on the alloy samples were measured by the electrochemical technique known as linear polarization. The ohmic resistance is determined from a plot of the DC current versus DC voltage of a sample exposed in an electrolyte in which the film is stable. DC voltage is controlled by means of an instrument known as potentiostat.

Corrosion rate and thus tarnishing rate has repeatedly been demonstrated to be inversely proportional to oxide film resistance and therefore the criticality of the composition and structure of the alloy of the present invention is demonstrated by film resistance measurements.

The data in Table II shows that alloy compositions outside the range specified in this present invention produce film resistance significantly lower than alloys within the specified range.

Alloy E in Table II is within the specified range and shows a relative film resistance of 136 kilohms; alloy F having an Al content below the specified range results in a film resistance of only 45 kilohms; alloy G with an Al content within the specified range but with an Ni content above the specified range results in a film resistance of only 64 kilohms; alloy H with an Al content still within the range but at the low end and with an Ni content above the specified range results in a film resistance of only 52 kilohms; and alloy I with both Al and Ni contents above the specified range although closer in film resistance, still only results in a film resistance of 91 kilohms and in addition, a large loss in formability and fabricability occurs in alloy I which is due to the presence of excessive amounts of the intermetallic compounds $\beta$ and $\gamma$ with limited ductility. As is stated above, to be considered tarnish resistant, in the terms of this invention, the alloy should posses a film resistance of at least 95 kilohms and preferably, at least 100 kilohms.

TABLE II

| Alloy | Composition, wt % | Film Resistance Kilohms |
|---|---|---|
| E | 90.22 Cu + 7.66 Al + 2.12 Ni | 136 |
| F | 91.31 Cu + 5.85 Al + 2.84 Ni | 45 |
| G | 86.78 Cu + 8.19 Al + 5.03 Ni | 64 |
| H | 88.46 Cu + 7.32 Al + 4.22 Ni | 52 |
| I | 85.87 Cu + 9.02 Al + 5.11 Ni | 91 |

EXAMPLE III

MECHANICAL AND FORMING PROPERTIES

Figure 2:
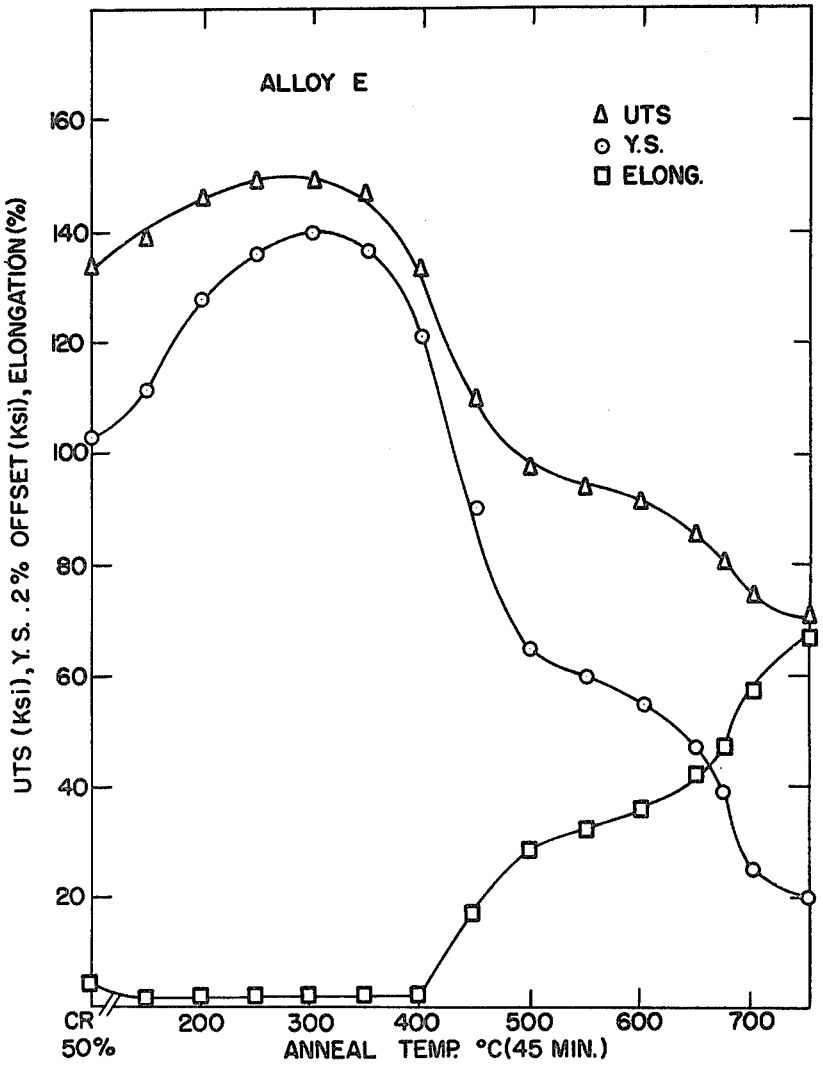
FIG. 2 is a graph showing tensile properties versus anneal temperatures for an alloy of the present invention.

Alloys of this invention (such as alloy E) are characterized by high strength, good ductility, and good formability. FIG. 2 illustrates the excellent mechanical property levels of alloy E of Table II attainable in the 50% cold rolled condition and after a range of annealing temperatures. The alloys listed in Table III were prepared in the same manner as in Example II and were tested for mechanical properties and formability. When Al and/or Ni levels are at higher levels than specified, (alloys G and I) ductility and formability decreases significantly. When Al and/or Ni levels are at lower levels than specified (alloys F and J) ductility increases but a significant loss occurs in strength levels. Properties determined on commercial 70/30 brass are shown for comparison.

TABLE III

| | Composition (Weight %) | | | Tensile Properties- Annealed | | | Formability | |
|---|---|---|---|---|---|---|---|---|
| Alloy | Cu | Al | Ni | **Yield *Strength | *Tensile Strength | Percent Elongation | Limiting Draw Ratio | Olsen Bulge Height |
| A | 89.93 | 7.98 | 2.09 | 53 | 86 | 39 | 2.12 | .412" |
| G | 86.78 | 8.19 | 5.03 | 62 | 91 | 32 | 2.03 | .352" |
| I | 85.87 | 9.02 | 5.11 | 68 | 95 | 30 | 1.93 | .351" |
| F | 91.31 | 5.85 | 2.84 | 18 | 66 | 62 | 2.12 | .491" |
| J | 90.03 | 5.89 | 3.81 | 32 | 72 | 50 | 2.06 | .398" |
| 260 | 70Cu | 30Zn | | 14 | 49 | 64 | 2.15 | .437" |

*Values are given in thousands of psi
**Yield strength determined by 0.2% offset method

EXAMPLE IV

IMPURITY EFFECTS

An alloy was prepared in the same manner as in Example III comprising 7.97% Al, 2.03% Ni, copper and the following impurities: 0.03% Pb, 0.03% Sn, 0.03% P, 0.03% Si, 0.05% Fe, 0.05% Mn, and 0.10% Zn. The mechanical properties were as follows: for the 50% cold rolled condition, yield strength 114,000 psi, tensile strength 141,000 psi, elongation 2.8%; for the 700° C. annealed condition, yield strength 46,000 psi, tensile strength 85,000 psi, elongation 38.5%. The limiting draw ratio was 2.12 and the Olsen Bulge Height was 0.413". Relative oxide film resistance was somewhat decreased to 95 kilohms due to the presence of the impurity additions. Thus, no penalty in mechanical properties or formability resulted from the presence of the relatively large total impurity level as compared with state-of-the-art commercial practice and only a moderate penalty in tarnish resistance occurred.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A process for making a tarnish resistant copper alloy having a film resistance of at least 95 kilohms, said process comprising the steps of:

A. forming a hot liquid solution of metals consisting essentially of the following constituents in the following amounts in percent by weight:

Al 7–8.5
Ni 1.5–2.5
Cu 89–91.5

B. cooling the metal solution to form a solid; and

C. subjecting the solid to a heat treatment to produce a metallic structure comprising an alpha phase matrix made of aluminum in solid solution with copper and containing dispersed NiAl, said structure containing less than 2 volume percent beta and gamma phases.

2. The process as set forth in claim 1 wherein step C is effected by:

1. hot rolling, thereafter
2. cold rolling, and thereafter
3. annealing.

3. The process as set forth in claim 2 comprising the further steps of repeating steps 2 and 3.

4. The process as set forth in claim 2 wherein step 1 is done at 900°–600° C., step 2 reduces the thickness of the solid metal by about 50%, and step 3 is done at about 700° C.

5. The process as set forth in claim 1 wherein, in step A, a solution having the following compositions in percent by weight is formed:

Al 7.7–8.3
Ni 1.8–2.2
Cu Balance.

6. The process as set forth in claim 1 wherein the solution also includes conventional impurities typically found in commercial based alloys.

7. The process as set forth in claim 1 wherein the solution includes impurities selected from the group consisting of lead, tin, phosphorus, iron, manganese, zinc, silicon, and mixtures thereof in a total amount no greater than 0.5 weight percent.

8. A process as set forth in claim 1 wherein the resulting alloy is characterized by a film resistance of at least 100 kilohms.

9. The process as set forth in claim 1 wherein the resulting copper alloy has the following minimum properties:

yield strength 46,000 psi
tensile strength 85,000 psi
elongation 38.5%
limiting draw ratio 2.12
Olsen Bulge Height 0.413 inches

* * * * *